US007497691B2

(12) United States Patent
Urano

(10) Patent No.: US 7,497,691 B2
(45) Date of Patent: Mar. 3, 2009

(54) CABLE CONNECTION STRUCTURE IN ELECTRIC VEHICLE

(75) Inventor: Tohru Urano, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/071,694

(22) Filed: Feb. 25, 2008

(65) Prior Publication Data

US 2008/0227304 A1 Sep. 18, 2008

(51) Int. Cl.
*H01R 33/00* (2006.01)

(52) U.S. Cl. ..... 439/34; 439/559; 439/908

(58) Field of Classification Search ..... 439/34, 439/556, 559, 587, 874, 908
See application file for complete search history.

(56) References Cited

U.S. PATENT DOCUMENTS

| | | | | |
|---|---|---|---|---|
| 5,316,347 | A * | 5/1994 | Arosio | 285/26 |
| 6,443,498 | B1 * | 9/2002 | Liao | 285/124.1 |
| 6,702,612 | B2 * | 3/2004 | Miyazaki et al. | 439/559 |
| 7,150,631 | B2 * | 12/2006 | Reed et al. | 439/34 |
| 7,291,024 | B2 * | 11/2007 | Kiyota et al. | 439/76.2 |
| 2002/0061677 | A1 * | 5/2002 | Iwata | 439/475 |
| 2002/0096379 | A1 * | 7/2002 | Sims et al. | 180/164 |
| 2002/0096879 | A1 * | 7/2002 | Liao | 285/124.1 |

FOREIGN PATENT DOCUMENTS

| | | |
|---|---|---|
| JP | 8-48164 A | 2/1996 |
| JP | 9-277840 | 10/1997 |
| JP | 2002-171636 | 6/2002 |
| JP | 2006-271130 | 10/2006 |

* cited by examiner

*Primary Examiner*—James Harvey
(74) *Attorney, Agent, or Firm*—Birch, Stewart, Kolasch & Birch, LLP

(57) ABSTRACT

The cable connection structure in an electric vehicle includes a main body of the electrical machinery having an inclined face with respect to the detaching direction; a terminal connector unit being formed contiguously to and separately from the main body and having an insertion opening through which the cable is inserted into the terminal connector unit and a contact face which intimately contacts with the inclined face; a busbar projecting into the terminal connector unit through connecting openings formed on the inclined face and the contact face and having one terminal being connected to the inside of the main body and the other terminal being electrically connected to the terminal of the cable inside the terminal connector unit; and one or more connection bolts, penetrating the inclined face and the contact face, for detachably coupling the main body and the terminal connector unit, improving maintenance efficiency and reducing the costs.

10 Claims, 8 Drawing Sheets

CABLE CONNECTION STRUCTURE IN ELECTRIC VEHICLE

BACKGROUND OF THE INVENTION

1. Field of the Invention

The present invention relates to a cable connection structure in an electric vehicle to connect cables flowing power from a battery to a device in the vehicle.

2. Description of the Related Art

A general electric vehicle supplies electric power from a battery to the driving motor of the vehicle through cables (e.g., see Patent Reference 1).

[Patent Reference 1] Japanese Patent Application Laid-Open (KOKAI) No. HEI 8-48164

Here, description will now be made in relation to the schematic configuration around the driving motor of an electric vehicle obtained through the creation of the present invention with reference to accompanying drawing FIG. 9, which is a perspective diagram schematically illustrating an electric vehicle seen from the behind.

As shown in FIG. 9, electric vehicle (vehicle) 100 includes driving motor 101 for driving vehicle 100, MCU (Motor Control Unit) 102 incorporating an inverter and a controller (both not shown) and DC/DC converter 103 accommodating an charger (not shown).

Driving motor 101 is arranged on the rear axle, and MCU 102 is disposed above driving motor 101. DC/DC converter 103 is arranged contiguously to the left side of MCU 102.

Driving motor 101, MCU 102, and DC/DC converter 103 are fixed to motor mounting frame 104 via a non-illustrated bracket or the like. The motor mounting frame 104 is fixed to a non-illustrated cross member of vehicle 100.

Further, a battery (not shown) charged with electric power to drive vehicle 100 is arranged under the floor (not shown) of vehicle 100 and forward MCU 102.

Driving motor 101 and the battery are electrically interconnected to MCU 102 by a number of cables 106, through which direct current is supplied from the battery to MCU 102 and through which cables the three-phase alternating current obtained by an inverter in MCU 102 converting the direct current into three-phase alternating current is supplied to driving motor 101.

The reference number 105 represents the driving mechanism which is a driveline for transmitting driving force generated by driving motor 101 to non-illustrated driving wheels and which is formed by a differential gear, various shafts, and other elements (all not shown). The driving mechanism is connected to driving motor 101 operable to transmit driving force to driving motor 101.

Here, the configuration of the connection between cables 106 and MCU 102 will now be detailed. As shown in FIG. 10, a terminal connector unit 102A is formed on MCU 102 to be connected to terminals 106A of cables 106 which connects MCU 102 to motor 101 and battery arranged below. Terminal connector unit 102A is formed by a cantilever horizontally projecting from the upper side of MCU main body 102B.

Inside the MCU 102, busbars 102C are installed to electrically connect cables 106 and MCU main body 102B. A bolt hole with a thread corresponding to bolt 113 is formed on the end of each busbar 102C.

Cables 106 are inserted into MCU 102 through flange 111 from the bottom of terminal connector unit 102A. Flange 111 is crimped onto against the bottom of terminal connector unit 102A by bolt 112. That avoids water immersion into the inside of MCU 102 through insertion sections of cables 106.

One end of each cable 106 takes the form of a so-called round terminal, and each terminal 106A is formed into a round ring shape through which bolt 113 penetrates. Terminal 106A of cables 106 and corresponding busbar 102C are engaged by bolt 113 in the machine direction of vehicle to thereby electrically connect MCU 102 and cables 106. On the rearface of terminal connector unit 102A, closable working window 114 is formed to allow an operator to fasten bolt 113.

If the layout design restricts driving motor 101 and battery to being arranged below MCU 102 like vehicle 100, cables 106 are preferably distributed to be connected to MCU 102 (specifically terminal connector unit 102A) from the bottom of MCU 102 so that the lengths of cables 106 becomes the shortest.

MCU 102 should be removed from vehicle 100 as shown in FIG. 11 when in vehicle 100 described with reference to FIGS. 9 and 10, maintenance of units such as motor 101 arranged under MCU 102 is to be performed. MCU 102 should be detached from vehicle 100 in the event of maintenance of MCU 102 itself.

If MCU 102 is disposed under floor (here, a trunk floor) 120 of vehicle 100, the operator temporarily lifts MCU 102 to a position (i.e., the position at which bolts 113 becomes higher than floor 120) which allows the operator to disengaging cable 106 through working window 114 to remove MCU 102 from vehicle 100 through floor opening 120A formed on floor 120 because busbars 102C are engaged to cables 106 by bolts 113 along the machine direction. Further, the operator needs to unfasten bolts 113 inside the MCU 102 being lifted. For this reason, vehicles of a type exemplified by vehicle 100 makes the maintenance of MCU 102 and other elements under MCU 102 complex.

In addition, MCU 102 should be lifted to a position at which the operator can deal with MCU 102 through working window 114. That has required an adequate ample length of each cable 106, but has been causes of cost raise and weight increase.

Cables 106 used in an above electric vehicle 100 have large diameters and high stiffness and therefore tend not to elastically deform with ease. For this reason, even if cables 106 have adequate ample length, the elasticity of the ample length applies upwardly heaving force to MCU 102, which force unnecessarily loads on terminals 106A in a normal installation state. Conversely, if ample lengths of cables 106 are set to be shorter, the stiffness of the cables 106 further greatly loads on lifting of MCU 102, lowering the operational efficiency.

These problems arise not only in connection of cables 106 and MCU 102 but also in connection of any electric machinery for any usage purpose.

The detaching direction of an electric machinery is not limited to vertical direction, and the same problems arises in the case where cables are connected in a different direction from a detaching direction.

SUMMARY OF THE INVENTION

With the foregoing problems in view, the object of the present invention is to provide a cable connection structure in an electric vehicle in which cables are connected to an electric machinery in a different direction from the detaching direction of the electric machinery, improving maintenance efficiency and reducing the cost.

To attain the above object, as a generic feature, there is provided a cable connection structure in an electric vehicle which is powered by driving force generated by a motor and in which a terminal of a cable is connected to an electrical machinery detachable from the vehicle, comprising: a main body of the electrical machinery, serving as a main element, having an inclined face imaginary normal of which is inclined with respect to the detaching direction; a terminal connector unit being formed contiguously to and separately from the main body and having an insertion opening through which the cable is inserted into the terminal connector unit and a contact face which intimately contacts with the inclined face; a busbar projecting into the terminal connector unit through connecting openings formed on the inclined face and the contact face and having one terminal being electrically connected to the inside of the main body and the other terminal being electrically connected to the terminal of the cable inside the terminal connector unit; and one or more connection bolts, penetrating the inclined face and the contact face, for detachably coupling the main body and the terminal connector unit.

In order to remove the electric machinery, the main body and the terminal connector unit can be decoupled by unfastening the connection bolts. The main body, without alteration, can be removed from the vehicle. That can eliminate the requirement for temporary movement of the electric machinery in the detaching direction. Further, since the connection bolts are inclined with respect to the detaching direction, the operator can easily fasten/unfasten the connection bolts and maintenance efficiency can be greatly enhanced.

Still further, the ample length of the cable can be shortened, it is possible to reduce costs and weight, concurrently saving the space inside the vehicle.

In addition, since the main body of the electric machinery and the terminal connector unit are coupled only at the connection between the inclined face and the contact face, a sealing process merely performed on the connection can ensure sufficient water tightness, which can make the cable connection structure simple.

As a preferable feature, the cable connection structure may further comprise: a battery for retaining electric power to drive the electric vehicle, and the electric machinery may be a motor control unit for adjusting the electric power that is to be supplied from the battery to the motor.

A general MCU is connected a greater number of cables through which relatively high electric currents should be flown and which consequently has large diameters, high stiffness, and heavy weights. However, the present invention sets the lengths of the cables which are guided into the MCU shorter than those used in a conventional electric vehicle, so that improvement in maintenance efficiency and cost reduction can be realized.

As another preferable feature, the detaching direction may be the vertical direction; and the terminal connector unit may be arranged contiguously to a side face of the main body.

In an electric vehicle with an electric machinery into which cables are inserted from the bottom, the electric machinery heavy in weight can be detached from the vehicle without being temporarily lifted in the upwardly vertical direction. The maintenance efficiency can be further enhanced.

As an additional preferable feature, the terminal of the cable may be detachably connected to the busbar in the detaching direction by a bolt; and the terminal connector unit may have a closable access opening, so that an operation to detach the terminal of the cable from the busbar is performed in the detaching direction through the access opening.

The presence of the access window makes it possible to surely connect the terminal of the cable and the busbar. Concurrently, the terminal of the cable and the busbar can be connected/disconnected with ease from the detaching direction through the access window.

As a further preferable feature, a face of the main body facing the detaching direction is substantially flush with a face of the terminal connector unit facing the detaching direction.

Additionally, the end face of the electric machinery facing the detaching direction is preferably set to be towards the detaching direction with respect to the face of the terminal connector unit facing the detaching direction. In other words, the side of the terminal connector unit facing the detaching side is preferably formed so as to horizontally extend from the top end of the inclined face of the main body or from the below the top face.

With this configuration, the face of the terminal connector unit facing the detaching direction does not project outside the face of the main body facing the detaching direction, so that the inner space of the vehicle can be saved.

As still another preferable feature, the terminal connector unit may include: a busbar guiding section for guiding the busbar from the connecting opening to the terminal of the cable; and a bolt engaging section formed on the contact face, being in the form of a plate on which one or more bolt holes for the connection bolts are formed.

With this configuration, the busbar can be guided to the terminal of the cable through the connection openings formed on the inclined face of the main body and the contact face of the terminal connector unit.

Since formation of the bolt engaging section in the form of a plate on the contact face of the terminal connector unit does not causes the connection bolts to pass through the inner space of the terminal connector unit, there is no need to consider deformation caused by firmly fastening connection bolts. That can connect the main body to the terminal connector unit further firmly. That brings the main body into further intimately contact with the terminal connector unit, enhancing water tightness. In addition, bolts with shorter screws can be used as the connection bolts to advantageously reduce the costs.

Other objects and further features of the present invention will be apparent from the following detailed description when read in conjunction with the accompanying drawings.

DESCRIPTION OF THE PREFERRED EMBODIMENTS

Figure 1:
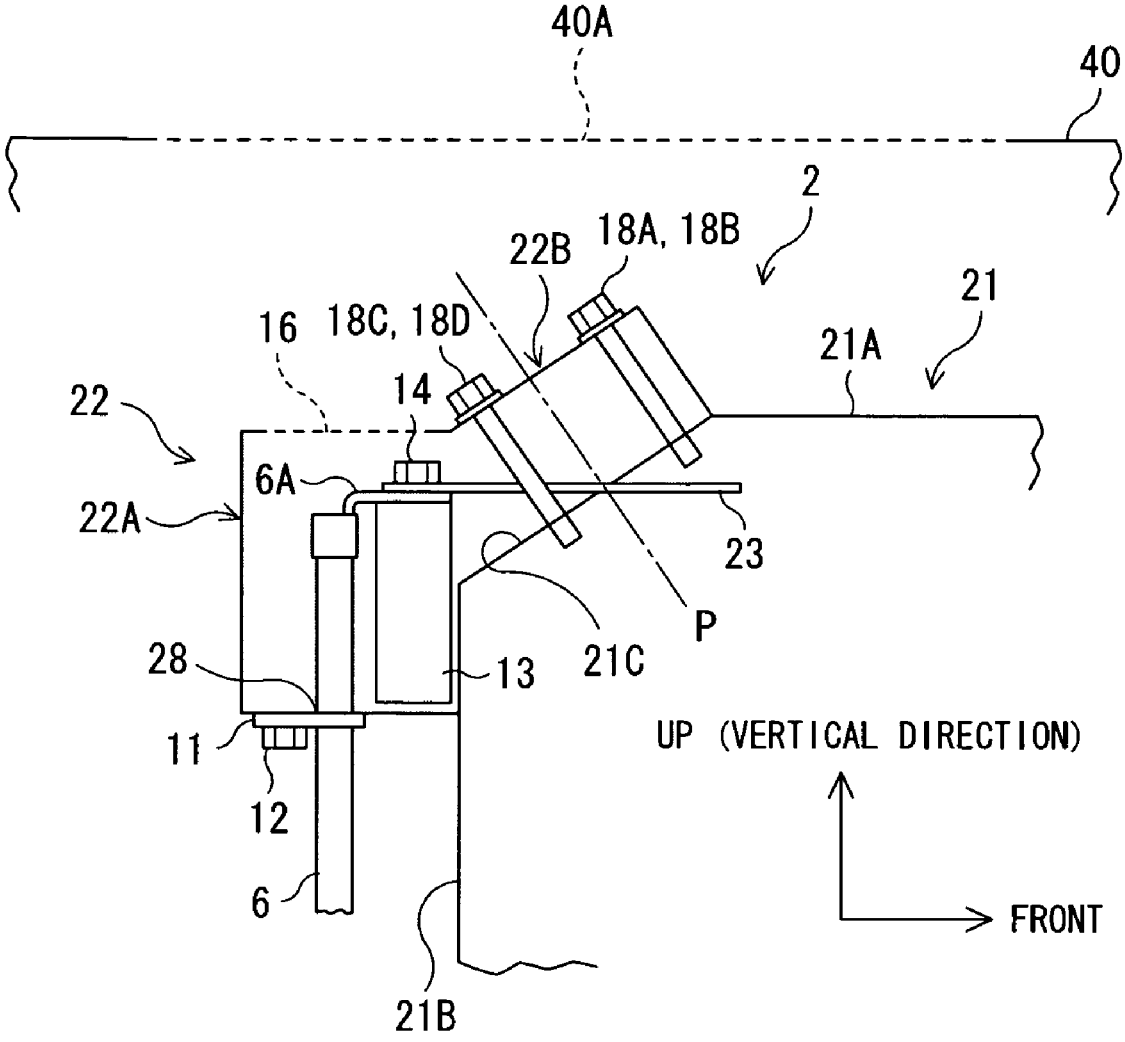
FIG. 1 is a side view schematically showing the configuration of a connection between an electric machinery and a cable of a cable connection structure in an electric vehicle according to a first embodiment of the present invention.
Figure 2:
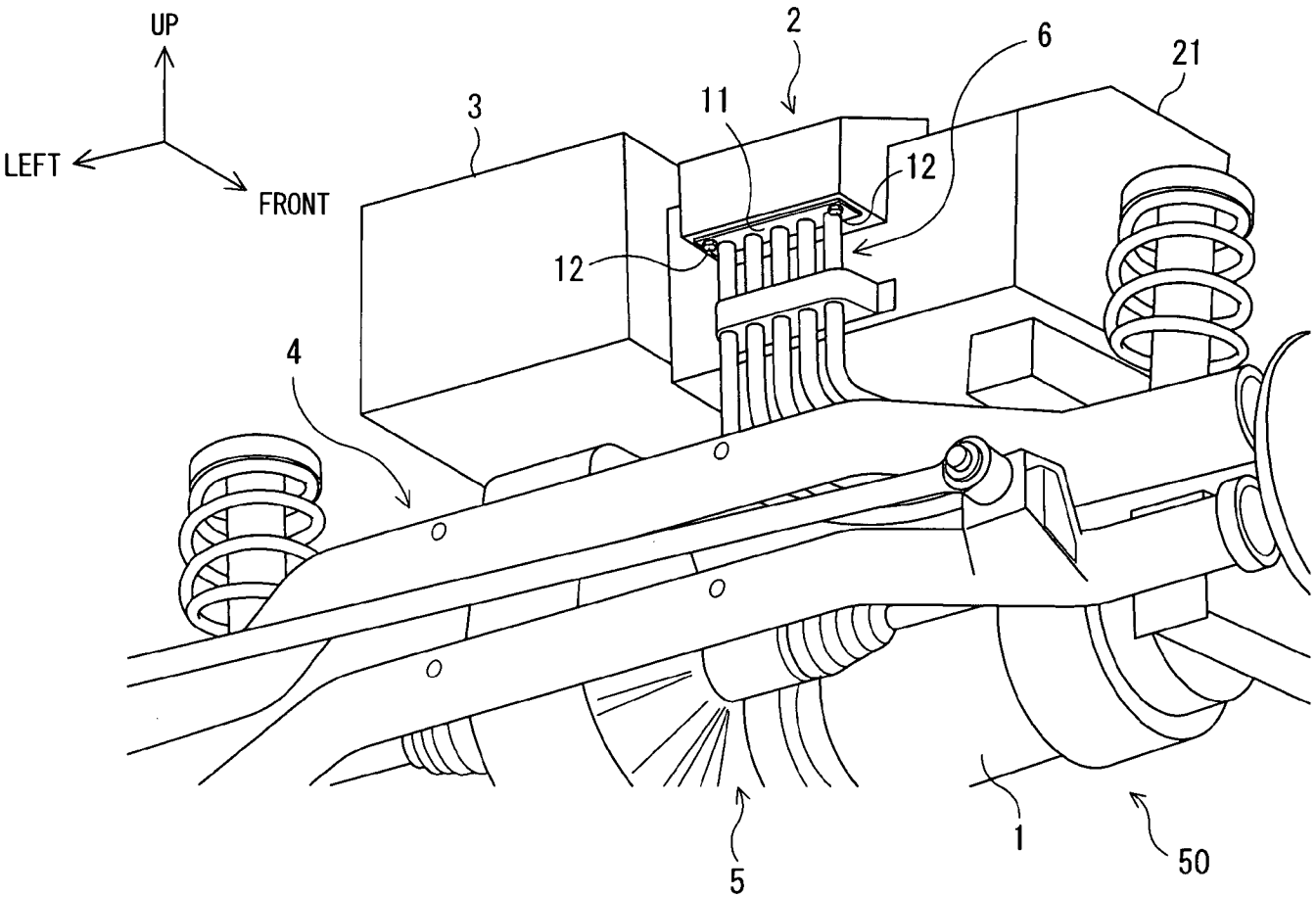
FIG. 2 is a perspective view schematically illustrating the configuration of the rear portion of the electric vehicle of the first embodiment seen from the behind the vehicle.
Figure 3:
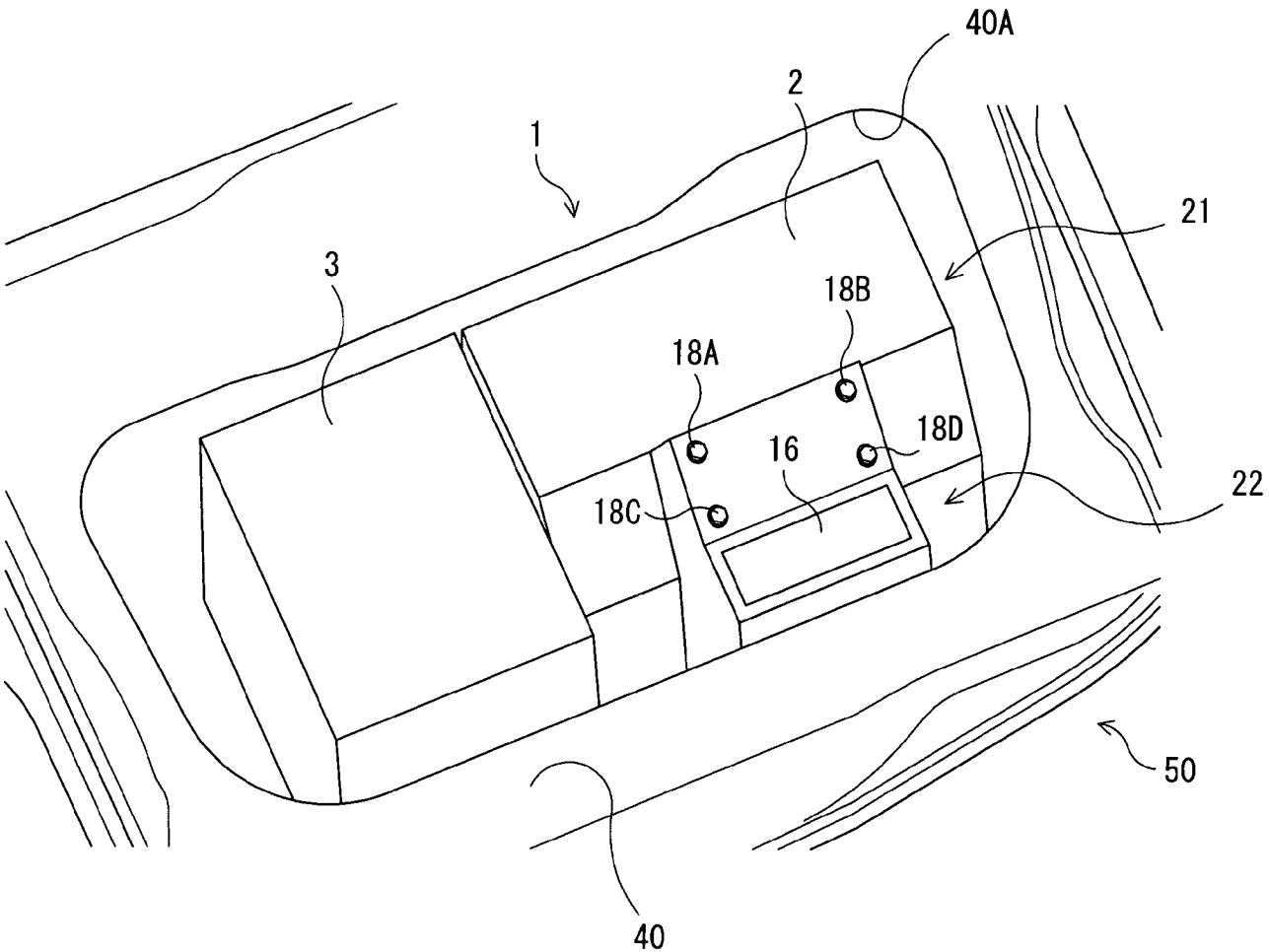
FIG. 3 is a perspective view schematically illustrating the configuration of the rear portion of the electric vehicle of the first embodiment seen from the above.
Figure 4:
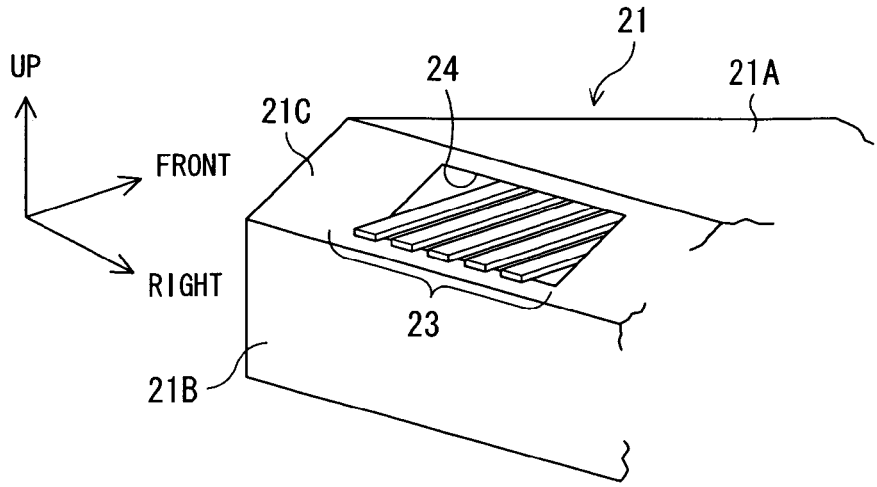
FIG. 4 is a perspective view illustrating the only electric machinery of the electric vehicle of the first embodiment.
Figure 5:
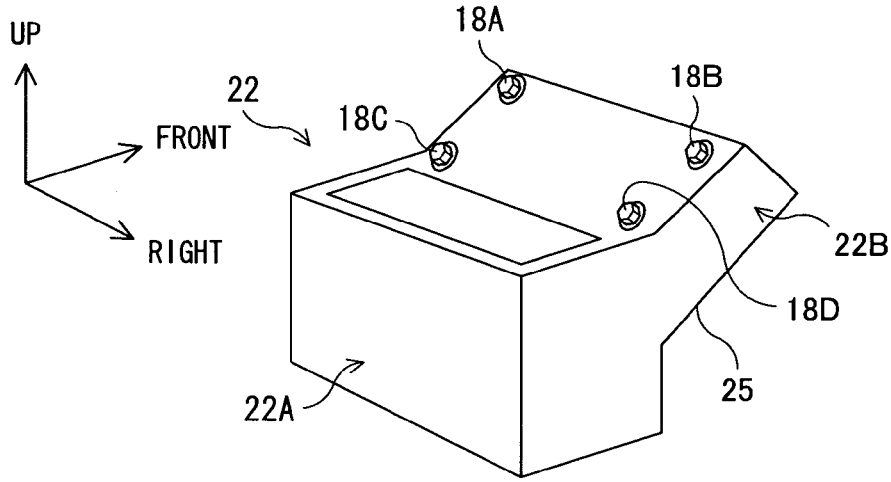
FIG. 5 is a perspective view schematically illustrating only the terminal connector unit of the first embodiment seen from the behind the vehicle.
Figure 6:
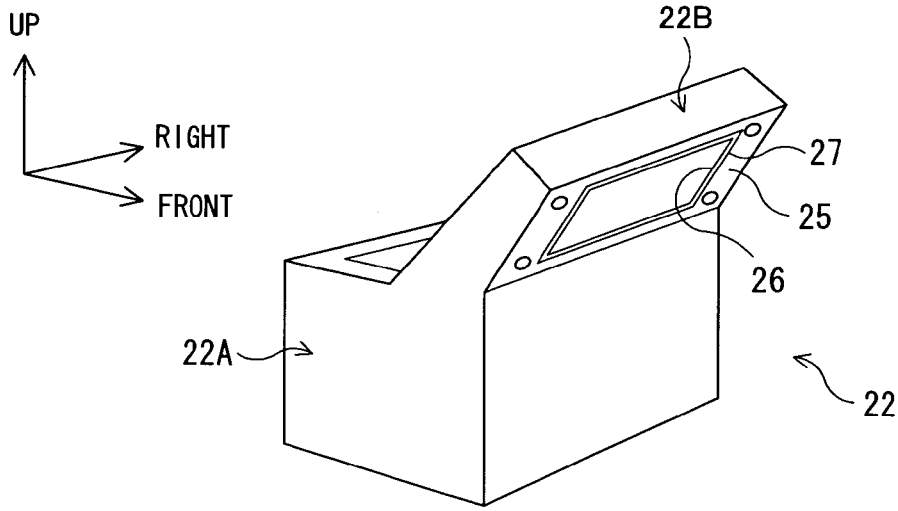
FIG. 6 is a perspective view schematically illustrating only the terminal connector unit of the first embodiment seen from the front side of the vehicle.

Various preferred embodiments of the present invention will now be described with reference to the accompanying drawings. FIGS. 1-6 show the configuration of a cable connection structure electric vehicle according to the first embodiment of the present invention. FIG. 1 is a side view schematically showing the configuration of a connection between an electric machinery and a cable; FIG. 2 is a perspective view schematically illustrating the configuration of the rear portion of the electric vehicle seen from the behind the vehicle; FIG. 3 is a perspective view schematically the configuration of the rear portion of the electric vehicle seen from the above; FIG. 4 is a perspective view illustrating only the electric machinery of the electric vehicle; FIG. 5 is a perspective view schematically illustrating only the terminal connector unit seen from the behind the vehicle; and FIG. 6 is a perspective view illustrating only the terminal connector unit seen from the front side of the vehicle.

As shown in FIG. 2, the electric vehicle (vehicle) 50 includes driving motor (motor) 1 for driving vehicle 50, MCU (Motor Control Unit) 2, incorporating an inverter and a controller (both not shown), for adjusting electric power supplied from the battery and controlling electric power to be supplied to driving motor 1, and DC/DC converter 3 accommodating an assembled charger (not shown).

Driving motor 1 is arranged on the rear axel, and MCU 2 is disposed above driving motor 1. DC/DC converter 3 is arranged contiguously to the left side of MCU 2. In addition to driving the vehicle 50, driving motor 1 functions as a generator to produce regenerated energy when vehicle 50 is in regenerative braking.

Driving motor 1, MCU 2, and DC/DC converter 3 are fixed to motor mounting frame 4 via a non-illustrated bracket or the like. The motor mounting frame 4 is fixed to a non-illustrated cross member of vehicle 50.

Further, a battery (not shown) charged with electric power to drive vehicle 50 is arranged under the floor (not shown) of vehicle 50 and forward MCU 2.

Driving motor 1 and the battery are electrically interconnected to MCU 2 by cables 6, through which direct current is supplied from the battery to MCU 2 and through which cables the three-phase alternating current obtained by an inverter in MCU 2 converting the direct current into three-phase alternating current is supplied to driving motor 1.

In addition, MCU2 and DC/DC converter 3 are electrically interconnected, so that regenerated energy which has been produced by driving motor 1 and which has been rectified in DC/DC converter 3 is supplied to the battery.

Since vehicle 50, as an electric vehicle, requires to introduce a relatively large electric current into MCU 2, driving motor 1, DC/DC converter 3 and others, cables 6 are set to be relatively large in diameter and high in stiffness in order to inhibit heat generation caused by current introduction.

The reference number 5 represents the driving mechanism which is a driveline for transmitting driving force generated by driving motor 1 to non-illustrated driving wheels and which is formed by a differential gear, various shafts, and other elements (all not shown). The driving mechanism is connected to driving motor 1 such that driving force is transmitted to driving motor 1.

As shown in FIGS. 1 and 3, MCU 2 can be detached from vehicle 50 in a detaching direction (i.e., the vertical direction) through floor opening 40A formed on floor 40 of vehicle 50 formed for the maintenance purpose.

Namely, detaching MCU 2 from vehicle 50 allows maintenance of MCU 2 itself and additionally maintenance of another element, such as driving motor 1, arranged below the MCU 2.

Here, description will now be made in relation to the configuration of connection between a number of cables 6 and MCU 2.

MCU 2 is formed by main body 21 and terminal connector unit 22, as shown in FIG. 1. The top face of MCU 2 is located under floor 40 and floor opening 40A for maintenance of vehicle 50.

Main body 21 incorporates an inverter and a controller (both not shown) and serves as the main part (element) of MCU 2.

Between top face 21A and rear side face 21B of main body 21 of MCU2, there is formed inclined face 21C perpendicular to an upward diagonal imaginary line (i.e., extending upward in the rearward direction). In other words, the imaginary normal P of inclined face 21C inclines in the rearward direction of vehicle 50 with respect to the vertical direction.

As shown in FIG. 4, opening (connecting opening) 24 is formed on inclined face 21C through which opening 24 a number of busbars 23 project backwardly in the substantial horizontal direction from the inside of main body 21.

The quantity of busbars 23 corresponds to the number of cables 6 (i.e., terminals 6A). One end of each busbar 23 is electrically connected to a non-illustrated internal device of main body 21, and the other end of the busbar 23 has a non-illustrated bolt hole with a thread into which bolt 14 is to be screwed.

Terminal connector unit 22 is formed contiguously to the rear side of main body 21 but is in the separated form from main body 21. Specifically, terminal connector unit 22 is in a box shape with the inner space to accommodate terminals 6A of cables 6 or the other end of the busbars 23.

As shown in FIG. 1, terminal connector unit 22 is arranged so as to contact with main body 21 along rear side face 21B, and inclined face 21C.

To simplify the explanation, terminal connector unit 22 is assumed to be divided into two parts of terminal connector box 22A and attachment 22B. Terminal connector box 22A is a portion of terminal connector unit 22 behind rear side face 21B of main body 21, and the remaining portion at the front side of terminal connector box 22A is regarded as attachment 22B.

As detailed below, terminal connector box 22A accommodates the connections of each cable 6 and corresponding busbar 23, and attachment 22B couples main body 21 and terminal connector unit 22 together so that busbars 23 project from inside of main body 21 through the contact face.

To begin with, terminal connector box 22A is detailed. As shown in FIG. 1, insertion openings 28 same in quantity as cables 6 are formed on the bottom face of terminal connector box 22A through which openings cables 6 extending along the vertical direction (i.e., in the detaching direction) from the position below MCU 2 are inserted into terminal connector box 22A. Each cable 6 is inserted through corresponding insertion opening 28 via flange 11.

Flange 11 has non-illustrated bolt holes with threads fitted to bolts 12 thereon. With this configuration, fastening bolts 12 makes the top face of flange 11 be in intimate contact with the bottom face of terminal connector box 22A, and water immersion into the inside of the MCU 2 is prevented when cable 6 is inserted into insertion opening 28, ensuring fluid tightness of MCU 2.

At one end of each cable 6, terminal 6A in the form of a so-called round terminal is formed. Terminal 6A is bend at the base thereof at approximate right angle toward the front side of vehicle 50 and disposed on terminal stand 13. A round ring-shape bolt hole through which bolt 14 is allowed to penetrate is formed on terminal 6A of each cable 6. Terminal stand 13 is fixed to terminal connector unit 22 and has non-illustrated bolt holes corresponding to bolts 14 on the top surface thereof.

Bolt 14 fits the threads of the bolt holes formed on corresponding terminal 6A and busbar 23 from the above to electrically connects terminals 6A of cables 6 and busbars 23.

In addition as shown in FIG. 5, a closable working window (access window) 16 is formed on the top face of terminal connector unit 22, so that the operator can fasten bolts 14 from the above through access window 16.

Next, attachment 22B is detailed. As shown in FIG. 6, attachment 22B has contact face 25 being in intimately contact with inclined face 21C of main body 21. On the contact face 25, opening (connecting opening) 26 identical in shape with connecting opening 24 is formed, so that busbars 23 project (i.e., connects) to the inside of terminal connector unit 22 from main body 21 through connecting openings 24 and 26 communicated with each other.

Opening 26 is surrounded with sealing member (a packing) 27 for the waterthightness purpose. Bolt holes are formed outside of packing 27 and closely to the four corners of packing 27 to accommodate bolts 18A-18D (see FIGS. 1, 3, and 5).

Attachment 22B and main body 21 are coupled by a number of bolts 18A-18D disposed on the four corners (of inclined face 21C and contact face 25), as shown in FIG. 3.

In other words, attachment 22B and inclined face 21C of main body 21 have a number of bolt holes (not shown) having threads fitted to bolts 18A-18D. Attachment 22B and main body 21 are coupled by screwing bolts 18A-18D into the threads of corresponding bolt holes, which have been formed on attachment 22B and inclined face 21C, in the direction perpendicular to the inclined face 21C (i.e., in the direction substantially identical to imaginary normal P, in this example, diagonally upward in the rearward direction). A packing (sealing member) 27 is disposed between the main body 21 and terminal connector box 22A to ensure the liquid tightness. With packing 27, fastening bolts 18A-18D inhibits water immersion into the space between external connecting portion 22C and main body 21.

For the sake of clarity, bolts 18A-18D are illustrated by solid lines but are arranged inside attachment 22B and main body 21 in FIG. 1.

The cable connection structure in an electric vehicle according to the first embodiment of the present invention has the above configuration and brings the advantages and the effects below.

When MCU 2 is to be detached from vehicle 50 in the upwards vertical direction, the operator firstly opens the working window 16, unfastens bolts 14 through the working window 16, and disconnects terminal 6A of each cable 6 from corresponding busbar 23.

After that, the operator unfastens bolts 18A-18D through floor opening 40A formed on floor 40 for maintenance from the rear to decouple main body 21 from terminal connector unit 22.

The above operation series disengages the entire bolt connection between main body 21 and terminal connector unit 22, so that main body 21 can be removed from vehicle 50 through floor opening 40A without being interfered by cables 6.

Conversely, when main body 21 is to be attached to vehicle 50, the operator first of all fixes main body 21 to a proper position in vehicle 50, and screws bolts 18A-18D into corresponding bolt holes formed on attachment 22B of terminal connector unit 22 and main body 21 to couple terminal connector unit 22 and main body 21.

Then the operator screws bolt 13 into bolt holes formed on terminal 6A of each cable 6 and the other end of corresponding busbar 23 through working window 16. After the cable 6 and corresponding busbar 23 are connected, working window 16 is closed. That electrically connects main body 21 and each cable 6.

The cable connection structure in an electric vehicle according to the first embodiment of the present invention disconnects external connecting portion 22C from main body 21 simply by unfastening bolts 18A-18D inclined backward with respect to the vertical direction (i.e., the detaching direction of main body 21) to some extent even if MCU 2 is arranged under the floor opening 40A of floor 40. Further, bracket 15 can be easily disconnected from busbar 23 by unfastening bolts 14 from the vertical direction (i.e., the detaching direction of main body 21) through working window 16.

With this configuration, MCU 2 can be detached from vehicle 50 without upwardly lifting heavy MCU2 to the position as high as floor 40, greatly improving maintenance facility. In the case where main body 21 is to be detached from vehicle 50 through trunk floor 40 at the rear side exemplified by the first embodiment, the operator fastens/unfastens bolts 18A-18D and bolts 14 from the rear side of vehicle 50, advantageously making it easy for the operator to fasten/unfasten bolts.

In addition, since the operator does not need to lift MCU 2 to floor 40, the ample length of each cable 6 can be greatly reduced, resulting in reduction in both cost and weight. Shorter cable length additionally saves space inside vehicle 50.

Further, reduction in the ample length of cables 6 lightens loads on terminals 6A and busbars 23 which loads are caused from the elasticity of long cables 6.

Main body 21 and terminal connector unit 22 are coupled to each other by bolts 18A-18D screwed at the outer four corners of packing 27 surrounding openings (i.e., connecting openings 24 and 26) which connects main body 21 and terminal connector unit 22. That improves the intimate contact between inclined face 21C of main body 21 and contact face 25 of terminal connector unit 22. Advantageously, simple configuration of bolting at the four corners guarantees sufficient liquid tightness of the contacting face between main body 21 and terminal connector unit 22.

Next, a second embodiment of the present invention will now be described. The configuration except the terminal connector unit of the second embodiment is identical to that of the first embodiment, so any repetitious description will be omitted here. Like reference numbers designate similar parts or elements between the first and the second embodiments.

Figure 7:
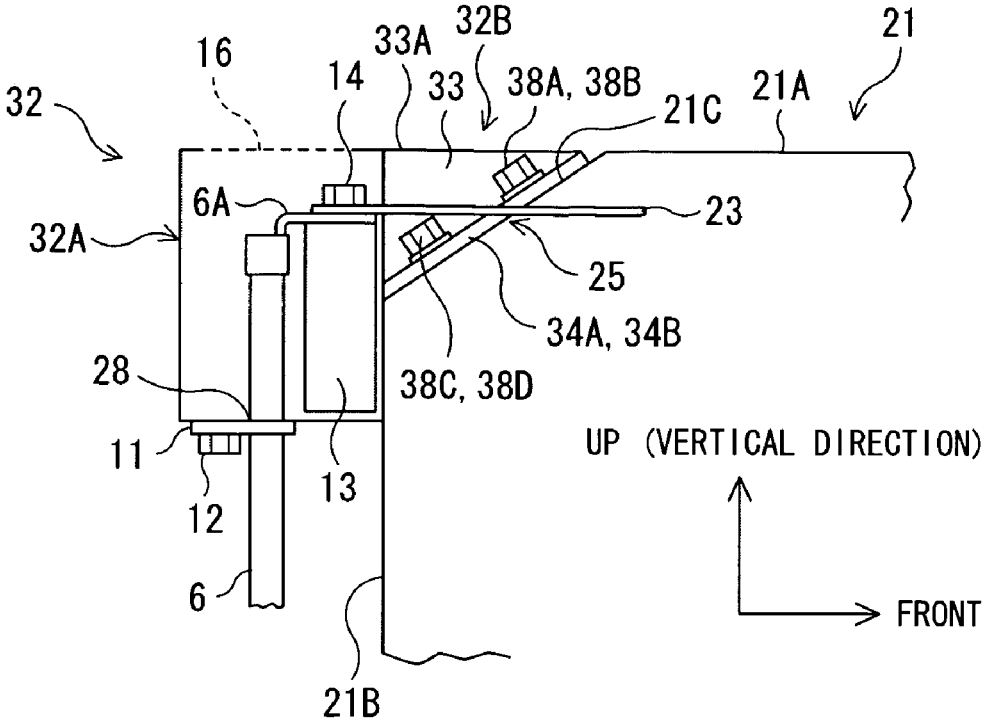
FIG. 7 is a side view schematically illustrating the configuration of a connection between the electric machinery and the cable of a cable connection structure in an electric vehicle according to a second embodiment of the present invention seen from a side.
Figure 8:
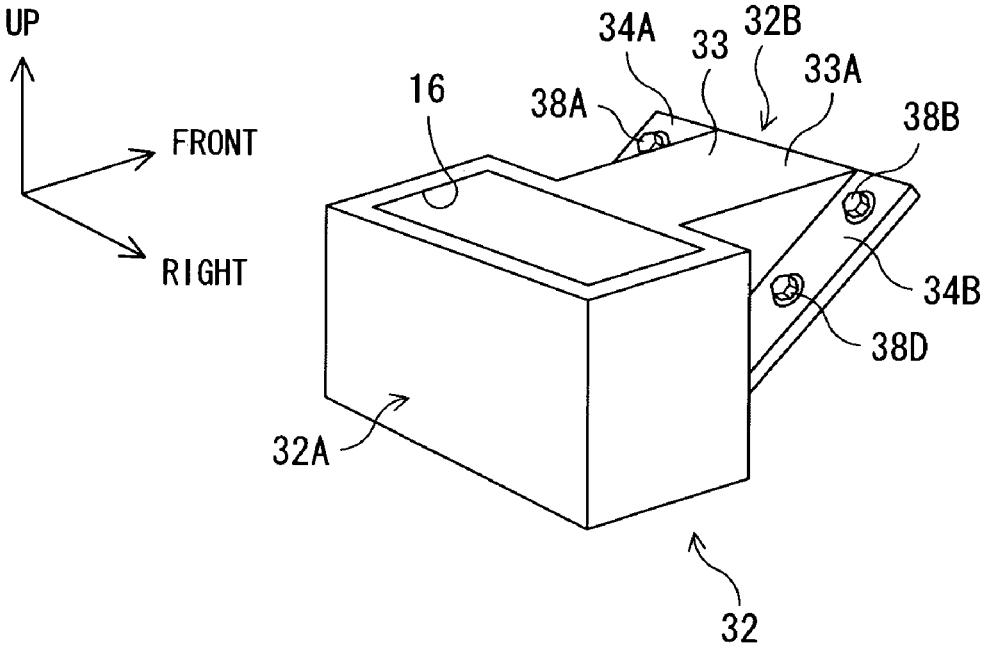
FIG. 8 is a perspective view illustrating only the terminal connector unit of the second embodiment seen from the behind the vehicle.
Figure 9:
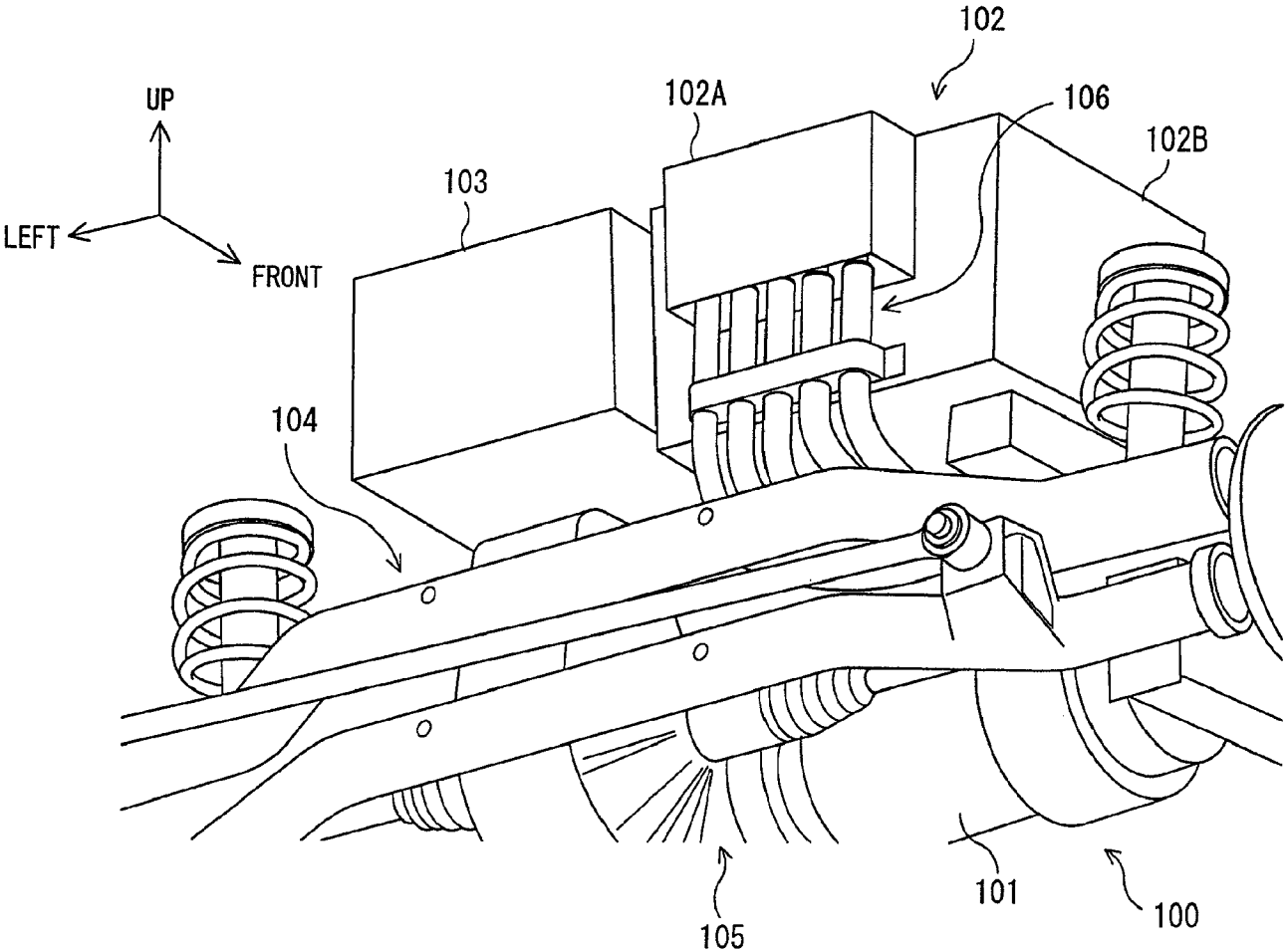
FIG. 9 PRIOR ART
FIG. 9 is a perspective view illustrating a configuration of the rear portion of an electric vehicle obtained through the creation of the present invention seen from the behind the vehicle.
Figure 10:
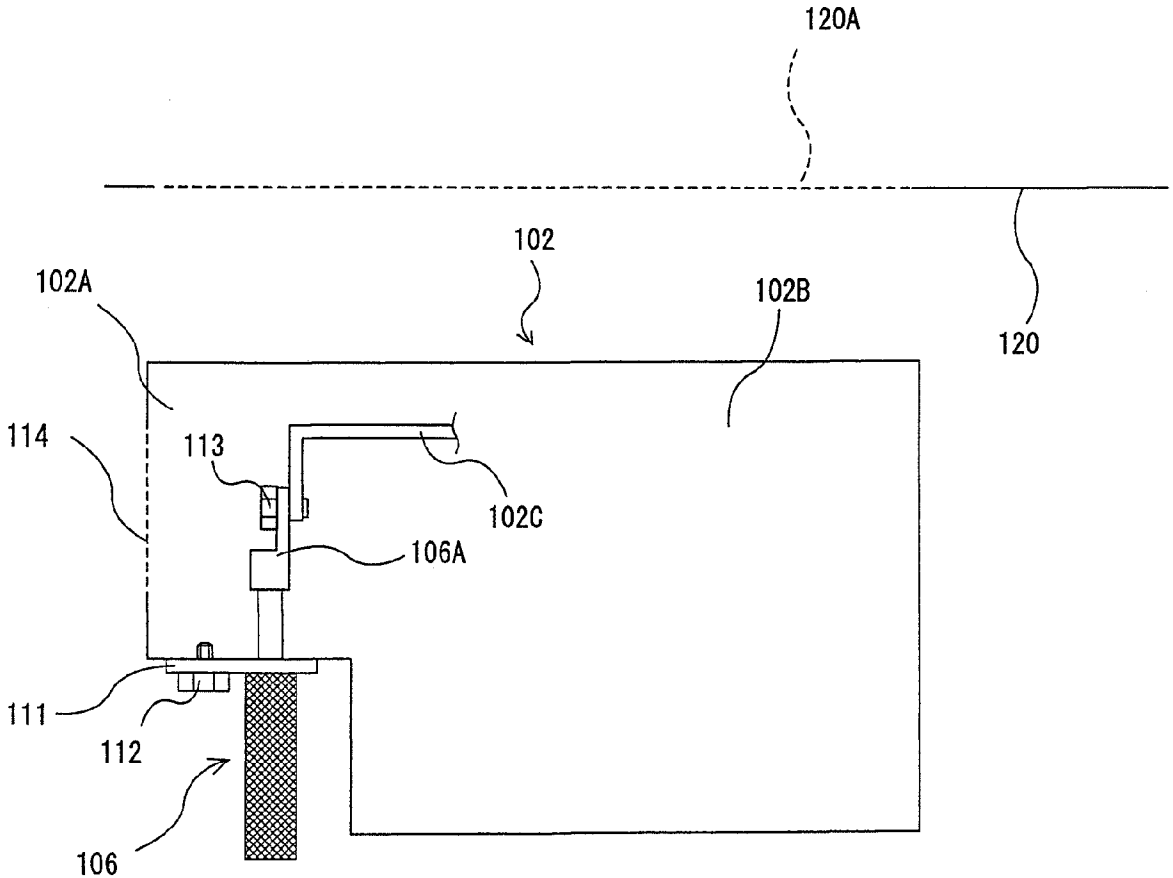
FIG. 10 PRIOR ART
FIG. 10 is a side view schematically illustrating the configuration of a connection between the electric machinery and the cable of an electric vehicle obtained through the creation of the present invention.
Figure 11:
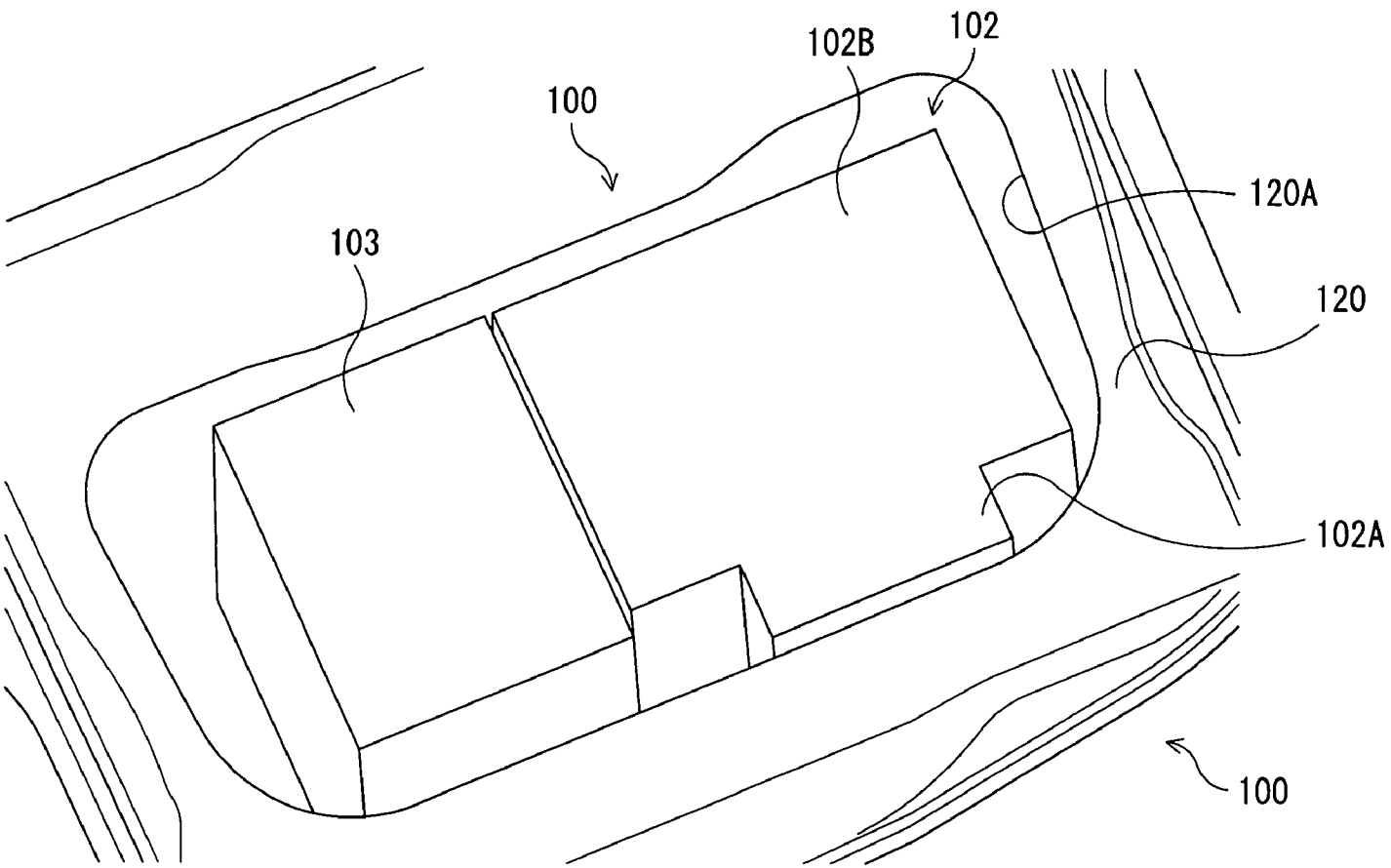
FIG. 11 is a perspective view illustrating the configuration of the rear portion of an electric vehicle obtained through the creation of the present invention seen from the above.

As shown in FIGS. 7 and 8, the shape of terminal connector unit 32 is different from terminal connector unit 22 of the first embodiment.

Similarly to the first embodiment, terminal connector unit 32 of the second embodiment is detailed by dividing into two parts of terminal connector box 32A which is a portion behind the rear side face 21B of main body 21 and attachment 32B which is the remaining portion on the front side from the terminal connector box 32A.

Terminal connector box 32A is the same in configuration as terminal connector box 22A of the first embodiment and takes the form of a box to ensure the space to accommodate terminals 6A of cables 6 and the other end of busbars 23.

On the other hand, attachment 32B is formed by busbar introducing section 33 and plates (bolt engaging section) 34A and 34B arranged on the both sides of busbar introducing section 33.

Busbar introducing section 33 includes connecting face (not shown) with connecting opening 26 serving as a part of contact face 25 and top face (i.e., detaching face) 33A being substantially flush with the top face (i.e., detaching face) 21A of main body 21. Busbar introducing section 33 accommodates busbars 23 projecting through connecting opeinings 24 and 26 from main body 21 and guides the busbars 23 to terminals 6A of cables 6 inside the terminal connector box 32A.

Plate 34A is arranged on the left side of busbar introducing section 33 and plate 34B is on the right side of busbar introducing section 33.

Each of plates 34A and 34B has the thickness suitable for bolting and has the shape coinciding with inclined face 21C of main body 21. On plate 34A and 34B, bolt holes with threads are formed parallel in the longitudinal (or lateral) direction correspondingly to bolts 38A-38D.

In other words, plates 34A and 34B and busbar introducing section 33 unitedly form contact face 25 coinciding with and intimately contacting with inclined face 21C of main body 21. Fastening bolts 38A-38D couples main body 21 and terminal connector unit 32.

The openings (connecting openings 24 and 26) are surrounded by packing 27, and bolts 38A-38D fasten the four outer corners of packing 27.

With the above configuration of the cable connection structure according to the second embodiment of the present invention, in order to detach MCU 2 from vehicle 50 in the upward vertical direction, the operator first of all opens working window 16 and unfastens bolts 14 through working window 16 to disengage terminals 6A of cables 6 from corresponding busbars 23.

After that, the operator unfastens bolts 38A-38D through floor opening 40A formed on floor 40 for maintenance to decouple main body 21 from terminal connector unit 32 from the position diagonally upward in the rearward direction and main body 21 become ready to be removed from vehicle 50.

Conversely, when main body 21 is attached to vehicle 50, the operator first of all fixes main body 21 to a proper position in vehicle 50, and fastens bolts 38A-38D to corresponding bolt holes formed through plates 34A and 34B of terminal connector unit 32 and main body 21 to couple terminal connector unit 22 and main body 21.

Then bolt 13 is screwed into a bolt hole formed on the other end of terminal 6A of each cable 6 and corresponding busbar 23 through working window 16. After the cable 6 and corresponding busbar 23 are connected, working window 16 is closed. That electrically connects main body 21 and each cable 6.

The cable connection structure in an electric vehicle according to the second embodiment guarantees the same advantages as the first embodiment. Specifically, the operator can fasten/unfasten bolts from the above, so that the operability in detaching MCU 2 from vehicle 50 can be greatly improved.

Further, since top face 33A of busbar introducing section 33 which serves as the top face of terminal connector unit 32 is substantially flush with top face 21A of main body 21, terminal connector unit 32 does not project above main body 21 and the second embodiment can advantageously save the space inside of vehicle 50 more than the first embodiment.

Top face 33A of busbar introducing section 33 should by no means be formed to be substantially flush with top face 21A of main body 21. Alternatively, top face 33A of busbar introducing section 33 may be positioned lower than top face 21A of main body 21. Since even with this positioning, the top of terminal connector unit 32 is accommodated inner side of the top face of main body 21, trunk floor 40 and floor opening 40A can be designed further freely.

The presence of busbar introducing section 33 makes it possible to surely guide busbars 23 to terminals 6A of cables 6 through connection openings 24 and 26 formed on inclined face 21C of main body 21 and on contact face 25 of terminal connector unit 32, respectively. Concurrently, the presence of plate 34A and 34B in the form of a pair of sheets arranged on the right and the left edges of contact face 25 prevents fastening bolts 38A-38D from penetrating the inner space of the terminal connector unit 32. There is no need to consider deformation of terminal connector unit 32 caused by firmly fastening bolts 38A-38D.

Accordingly, fastening bolts 38A-38D can be more firmly fastened than bolts 18A-18D in the first embodiment, and main body 21 can consequently be further firmly engaged to terminal connector unit 32. In addition, bolts with shorter screws can be used as fastening bolts 38A-38D to advantageously reduce the costs.

The present invention should by no means be limited to these foregoing embodiments, and various changes or modifications may be suggested without departing from the gist of the invention.

In the above first and the second embodiments, the electric machinery to which cables are connected is exemplified by an MCU, but should by no means be limited to such an MCU. Any electric machinery may be used. In particular, since a DC/DC converter and a vehicle-driving motor in addition to an MCU require relatively large electric currents and therefore need to be connected to cables larger in diameter and weight, the present invention carries effective reduction in both costs and weights.

In the foregoing embodiments, the electric machinery is detached from the vehicle in the vertical direction, to which the present invention should by no means limit. In other words, the electric machinery can be removed from the vehicle in any direction.

Further, the direction in which cables are connected to the electric machinery should by no means particularly be limited to, that is, cables can be connected to the electric machinery in any direction. The present invention can be further effectively applied to a vehicle in which cables are distributed in the same direction as the detaching direction of the electric machinery.

What is claimed is:

1. A cable connection structure in an electric vehicle which is powered by driving force generated by a motor and in which a terminal of a cable is connected to an electrical machinery detachable from the vehicle, comprising:

a main body of the electrical machinery, serving as a main element, having an inclined face which is inclined with respect to a detaching direction;

a terminal connector unit being formed contiguously to and separately from said main body and having an insertion opening through which the cable is inserted into said terminal connector unit and a contact face which intimately contacts with said inclined face;

a busbar projecting into said terminal connector unit through connecting openings formed on said inclined face and said contact face and having one terminal being electrically connected to the inside of said main body and another terminal being electrically connected to the terminal of the cable inside said terminal connector unit; and one or more connection bolts, penetrating said inclined face and said contact face, for detachably coupling said main body and said terminal connector unit.

2. A cable connection structure according to claim 1, further comprising: a battery for retaining electric power to drive the electric vehicle, wherein the electric machinery is a motor control unit for adjusting the electric power that is to be supplied from said battery to the motor.

3. A cable connection structure according to claim 1, wherein:

the detaching direction is the vertical direction; and said terminal connector unit is arranged contiguously to a side face of said main body.

4. A cable connection structure according to claim 1, wherein:

the terminal of the cable is detachably connected to said busbar in the detaching direction by a bolt; and said terminal connector unit has a closable access opening, so that an operation to detach the terminal of the cable from said busbar is performed in the detaching direction through said access opening.

5. A cable connection structure according to claim 1, wherein a face of said main body facing the detaching direction is substantially flush with a face of said terminal connector unit facing the detaching direction.

6. A cable connection structure according to claim 1, wherein said terminal connector unit includes:

a busbar guiding section for guiding said busbar from said connecting opening to the terminal of the cable; and a bolt engaging section formed on said contact face, being in the form of a plate on which one or more bolt holes for said connection bolts are formed.

7. A cable connection structure according to claim 2, wherein:

the detaching direction is the vertical direction; and said terminal connector unit is arranged contiguously to a side face of said main body.

8. A cable connection structure according to claim 7, wherein:

the terminal of the cable is detachably connected to said busbar in the detaching direction by a bolt; and said terminal connector unit has a closable access opening, so that an operation to detach the terminal of the cable from said busbar is performed in the detaching direction through said access opening.

9. A cable connection structure according to claim 8, wherein a face of said main body facing the detaching direction is substantially flush with a face of said terminal connector unit facing the detaching direction.

10. A cable connection structure according to claim 9, wherein said terminal connector unit includes:

a busbar guiding section for guiding said busbar from said connecting opening to the terminal of the cable; and a bolt engaging section formed on said contact face, being in the form of a plate on which one or more bolt holes for said connection bolts are formed.

* * * * *